US007412984B1

(12) United States Patent
Spencer et al.

(10) Patent No.: US 7,412,984 B1
(45) Date of Patent: Aug. 19, 2008

(54) PORTABLE PERSONAL SHADE AND COOLING DEVICE

(76) Inventors: Terrence Michael Spencer, 3245 E. Jerome Ave., Mesa, AZ (US) 85204; Nicolle Janine Spencer, 3245 E. Jerome Ave., Mesa, AZ (US) 85204

( * ) Notice: Subject to any disclaimer, the term of this patent is extended or adjusted under 35 U.S.C. 154(b) by 291 days.

(21) Appl. No.: 11/194,960

(22) Filed: Aug. 1, 2005

(51) Int. Cl.
*A45B 23/00* (2006.01)

(52) U.S. Cl. ..... 135/16; 135/25.4; 239/289

(58) Field of Classification Search ..... 135/16, 135/33.7, 91, 98, 15.1, 25.4; 239/273, 289, 239/280, 375, 379; 222/174
See application file for complete search history.

(56) References Cited

U.S. PATENT DOCUMENTS 2,005,602 A * 6/1935 Thomson ..... 239/18
2,727,366 A * 12/1955 Hagen ..... 62/304
2,941,695 A * 6/1960 Rich ..... 222/132
5,143,107 A 9/1992 Kelley
5,224,652 A * 7/1993 Kessler ..... 239/211
5,620,140 A 4/1997 Utter
5,979,793 A 11/1999 Louis
6,612,713 B1 * 9/2003 Kuelbs ..... 362/102
6,682,000 B1 * 1/2004 Apple ..... 239/289
6,886,759 B1 * 5/2005 Okronick et al. ..... 239/289
7,104,270 B2 * 9/2006 Dong ..... 135/16
2002/0078985 A1 * 6/2002 Farr ..... 135/16
2005/0172987 A1 * 8/2005 Byrnes ..... 135/33.5

OTHER PUBLICATIONS

Misty Mate, www.mistymate.com Web page copy.

* cited by examiner

*Primary Examiner*—Winnie Yip
(74) *Attorney, Agent, or Firm*—Gregory J. Nelson

(57) ABSTRACT

A portable personal shade and cooling device having a handle and a canopy. The handle defines a water reservoir connected to misting nozzles arranged around the periphery of the canopy. The handle incorporates a pressurization source which may be a gas containing cartridge, an external air pump or an integral air pump in the handle.

2 Claims, 2 Drawing Sheets

PORTABLE PERSONAL SHADE AND COOLING DEVICE

FIELD OF THE INVENTION

The present invention relates to a portable, personal shade and cooling device and more particularly relates to a canopy incorporating a cooling system which directs a fine, cooling mist of water on the user from a water supply contained within the canopy structure.

BACKGROUND OF THE INVENTION

Evaporative cooling devices are widely used and operate on the principle that heat is extracted from the air to cause evaporation and cooling. Residential and commercial cooling systems utilize this principle. This principle has also been adopted and applied to personal and portable cooling systems.

U.S. Pat. No. 5,979,793 shows a misting device having a conduit configured to supply fluid to at least one nozzle. The conduit communicates with a fluid compartment in the base. The base includes a pressure-providing device and the base may be mounted on wheels for portability.

U.S. Publication No. US2002/00078985 shows a mist-producing umbrella device providing a cooling mist for use at locations such as the beach. The mist-producing umbrella has a collapsible canopy and includes a water control assembly and a water reservoir. A pump is disposed in the housing and is connected to the reservoir and delivers water to a mist dispensing assembly.

U.S. Pat. No. 5,143,107 shows an umbrella which is an outdoor play toy for children. Water from a hose flows upwardly through the umbrella and sprays out through holes in the spokes to create a rain affect beneath the umbrella.

U.S. Pat. No. 5,620,140 shows a portable mist cooling device which delivers a fine spray mist for evaporatively cooling a local area. The apparatus includes a pressurizable container, valve and a spray nozzle or a plurality of nozzles coupled to the valve. A pump pressurizes the container. The device may be attached to the body of the user by a belt or clip so that it can direct a cooling mist in a hands-free manner.

Various other types of portable cooling devices using the evaporative cooling effect can be found and a number of these devices are sold under the designation Misty Mate® as shown on the Misting Mate website www.mistymate.com. Therefore, while there are numerous devices which utilize evaporative cooling, some of which are portable, there nevertheless exists the need for a portable cooling device which is compact, easy to use, easy to store and which provides the user shade as well as portability in a personal cooling device. Although some devices include a shade canopy, these devices are generally large and bulky or are intended to be secured in a fixed location as by a base or ground stake.

BRIEF SUMMARY OF THE INVENTION

Briefly, the present invention provides a portable cooling device which utilizes the evaporative effect to generate a fine cooling mist and which device also provides the user a canopy, such as an umbrella, to provide shade. Thus, the user is shaded from solar radiation and damaging ultraviolet rays and can initiate a cooling mist which is directed downwardly from the canopy onto and around user. The device may be used when engaged in various activities such as walking, hiking, playing sports such as golf or while sitting on a bench at an outdoor location while watching sports or other activities.

The present invention provides a canopy mounted on a handle. The canopy and handle may be similar to a conventional umbrella having a plurality of ribs which support the canopy. The handle projects downwardly from the center of the canopy terminating at a grip at the lower end. The handle is hollow and defines a reservoir for cooling fluid such as water. The reservoir communicates with a plurality of misting nozzles disposed around the periphery of the canopy. The nozzles are connected to the reservoir by flexible tubing. The lower end of the handle incorporates a pressurization source which will pressurize the reservoir to deliver water to the nozzles across a suitable valve. The pressurization source in one embodiment may be a gas-containing cartridge such as a small cartridge containing $CO_2$ gas which is selectively activated by the user.

In another embodiment, the reservoir may be pressurized from an external source such as an air hose across a suitable valve such as a Schrader-type valve of the type used on vehicle tires.

In yet another embodiment, the handle may include an air pump which can be manually actuated to cause the reservoir to be pressurized.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
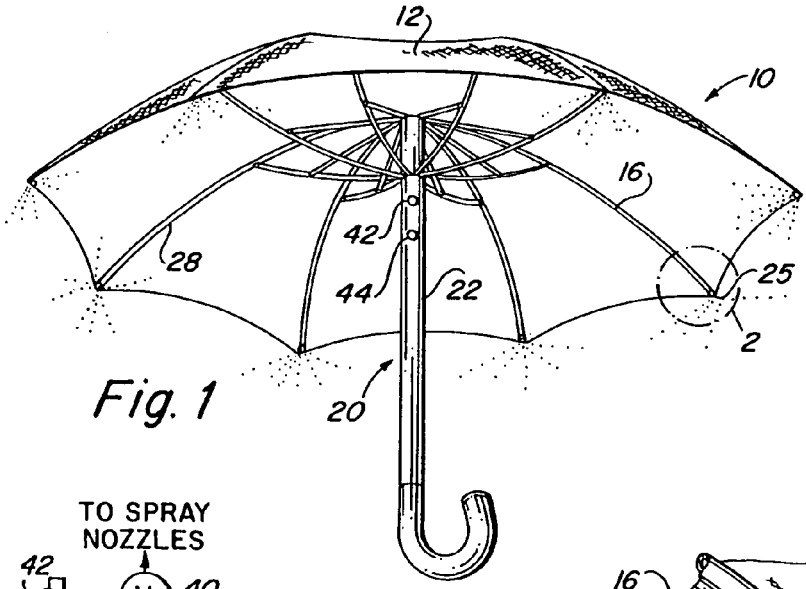
FIG. 1 is perspective view showing the portable shade and cooling device of the present invention.

Turning now to the drawings, particularly FIG. 1, the combination shade and cooling device of the present invention is shown and is generally designated by the numeral 10. The same numerals are used through the following description to identify the same or similar components. The device 10 has an umbrella-style canopy 12 which is of a suitable water-repellant material such as a treated fabric and is supported in the open position by a plurality of flexible ribs 16. A handle 20 extends downwardly from the center of the canopy. The canopy may be fixed in an open position but preferably the canopy is collapsible to a compact position when not in use. The canopy may be collapsed in a manner commonly used in the construction of umbrellas and well known to those skilled in the art.

The handle 20 has a generally tubular upper section 22 and a lower grip 24. The lower grip 24 is shown as being U-shaped, again as conventional. However, the lower grip portion may take other shapes such as a decorative knob or other configurations commonly utilized in the construction of parasols and umbrellas.

The canopy, when in an open position as shown in FIG. 1, provides shade to the user. The user, by holding the handle, may orient the umbrella to a position to provide the required shade.

In addition to providing shade, the device may also be used to direct a cooling mist downwardly on and around the user.

Figure 2:
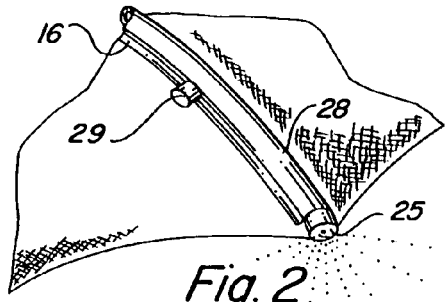
FIG. 2 is a detail view of the device as indicated in FIG. 1 showing the misting nozzles.

As best seen in FIG. 2, a plurality of nozzles 25 are provided at locations around the periphery of the canopy. Although the device will work with a single nozzle, it is preferred that multiple nozzles be provided at spaced-apart, peripheral locations. The nozzles are misting nozzles such as those availability from Misty Mate®. The nozzles are provided water by a plurality of flexible conduits 28 which extend along the supporting ribs 16 of the canopy. The conduits 28 may be clipped or may be attached to the ribs by clips 29 or adhesive or other conventional means of attachment.

A cooling water supply is contained in a reservoir 30 in the upper part of the tubular handle section 22. The handle can be any suitable material such as metal, but material such as PVC is preferred because of durability and corrosion resistance. The reservoir 30 has a lower wall 32 and an upper wall 34. The conduits 28 are connected to the misting nozzles and communicate with the reservoir 30 across a valve 40. The valve 40 may be any suitable type of valve such as a small ball valve having an operator 42 disposed on the upper handle section 22. The user, by adjusting the operator 42, can control the amount of fluid directed to the misting nozzles. The valve may be placed in a full off position which will terminate the flow of water to the misting nozzles. The reservoir may be filled with water by removing threaded plug 44.

Figure 3:
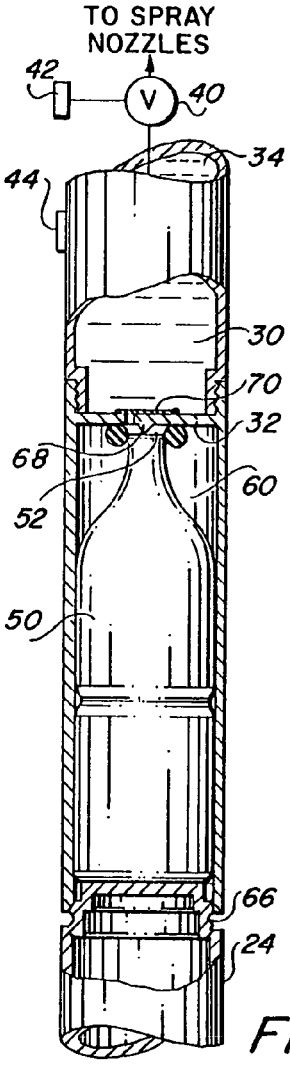
FIG. 3 is a view of a section of the handle of the device broken away to illustrate the water reservoir and one embodiment of the pressurization system which utilizes a cartridge.
Figure 4:
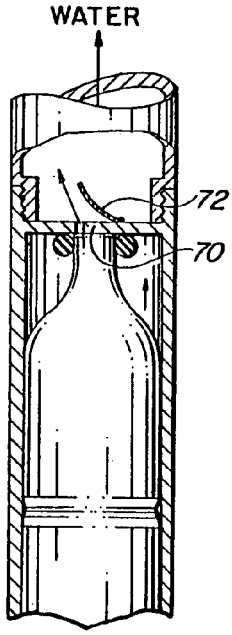
FIG. 4 is a view similar to FIG. 3 showing the pressurization cartridge actuated.

Referring to FIGS. 3 and 4, the reservoir may be pressurized from a pressure source such as a cartridge 50. The cartridge 50 is shown as the type of cartridge which commonly contains a gas such as $CO_2$ having a rupturable seal 52 at its upper end. When the seal is broken, the contents of the cartridge are released. The lower end of handle section 22 defines a chamber 60 below the water reservoir 30. The chamber 60 is configured to receive the gas cartridge 50 and access to the chamber 60 is achieved by unscrewing the grip portion 24 at threaded section 66. When the grip is removed, cartridge 50 may be axially inserted in the chamber 60 until it engages the small, downwardly depending projection 68 on wall 32. Apertures 70 extend through wall 32 and a small check valve 72 is disposed over the apertures. When handle 24 is placed in threaded engagement at threads 66 and tightened, the cartridge 50 will be forced upwardly so the cartridge seal 52 is ruptured. When the seal is ruptured, the pressurized contents of the cartridge will flow through the apertures 70 and across check valve 72 into the water reservoir 30 pressurizing the contents of the reservoir. The contents can then be discharged to the misting nozzles under the control of valve 40.

It is emphasized the water reservoir valve and pressurization system are all integrally housed within the structure of the handle.

Figure 5:
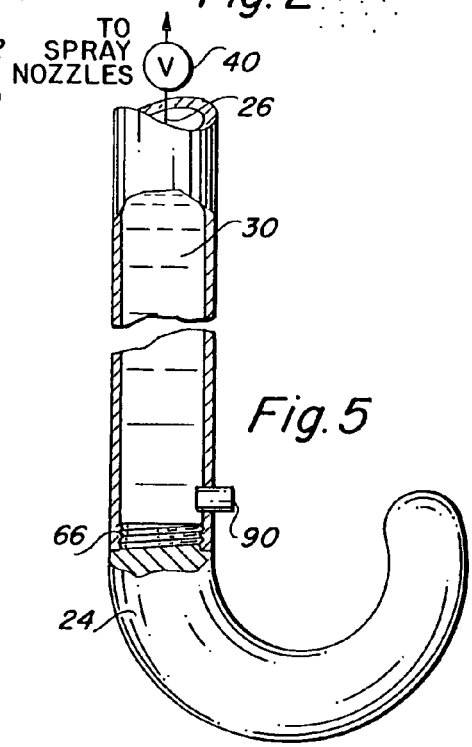
FIG. 5 is a view of the lower end of the handle partially broken away illustrating another embodiment of the pressurization system.

In FIG. 5 the handle portion is again shown defining a water reservoir 30 which communicates with the misting nozzles via flexible conduit 28 and valve 40. The lower end of reservoir 30 is provided with threads 66 so handle 24 may be engaged or disengaged from the lower end of handle section 22. With the handle disengaged, the reservoir can be filled with water from a suitable source such as a household tap.

With the reservoir filled and the device assembled, as shown in FIG. 5, the water reservoir 30 may be pressurized by means of valve 90. Valve 90 extends through the tubular wall of handle section 22 and communicates with the reservoir 30. Valve 90 is a Schrader-type valve in which pressurized air supply such as a conventional bicycle pump can be attached. The user can then operate the pump to pressurize the reservoir 30 to the desired pressurization level.

Figure 6:
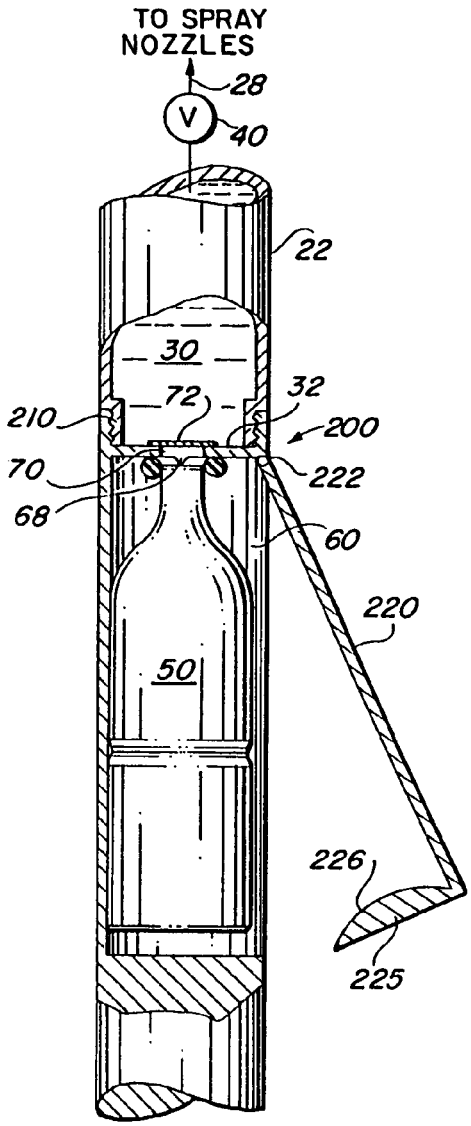
FIG. 6 is view of a portion of the handle of the device broken away to illustrate yet another embodiment of the pressurization system.
Figure 7:
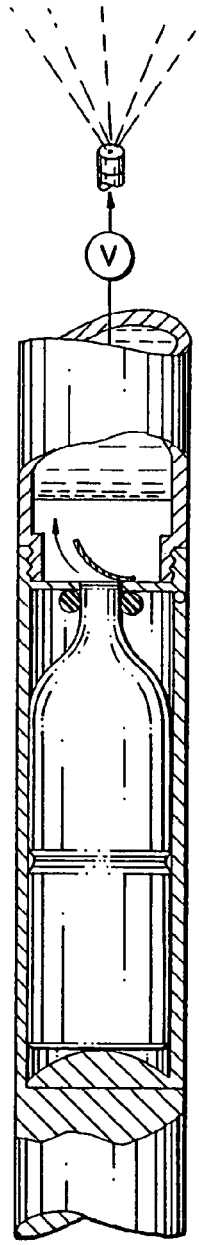
FIG. 7 is a view similar to FIG. 6 showing the pressurization system actuated to pressurize the water reservoir.

In FIGS. 6 and 7, yet another embodiment of the present invention is shown. This embodiment is similar to that shown in FIGS. 3 and 4, and, again handle section 22 defines a water reservoir 30 which can be disengaged at threaded section 210 to allow the user to fill the reservoir 30 with fluid. The reservoir communicates with the mist nozzles 25 via flexible conduit 28 and valve 40. Transverse wall 32 is provided with a projection 68 for puncturing the seal of cartridge 50. Apertures 70 communicate through the wall 32 across a one-way valve 72. The cartridge is housed in chamber 60 in the lower portion of handle section 22. Access is provided by an access door 220 which is formed in the sidewall of the chamber. The door 220 is pivotal at 222 and may be swung outward to access chamber 60 to remove or insert a pressure cartridge as required. When the cartridge is positioned as shown in FIG. 6, the door 220 may be then placed in the closed position shown in FIG. 6. It is to be noted that the lower end of the access door 220 carries a inwardly extending foot 225 having a raised center section 226. The raised center section 226 will engage the bottom end of the pressure cartridge 50 forcing it upwardly causing the pressure seal to be punctured and the contents can then be discharged into the water reservoir.

Figure 8:
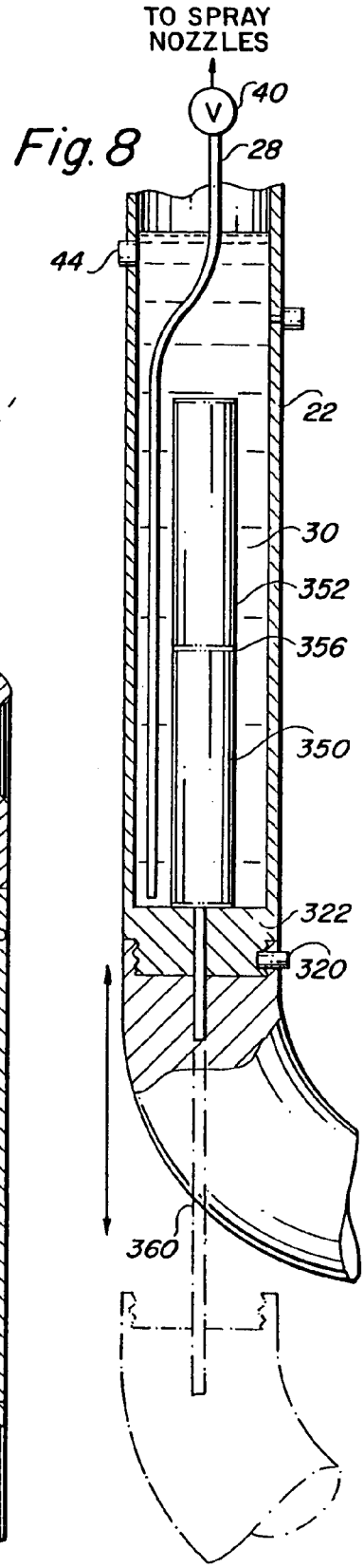
FIG. 8 is another view of the handle of the device of the present invention broken away to illustrate another embodiment of the present invention which utilizes an air pump.

Another embodiment of the present invention is shown in FIG. 8. Again, the handle section 22 defines a water reservoir 30 which may be filled with water via a removable plug 44. The grip 24 detachably engages the wall 322 at the lower end of the reservoir 30. The handle is detachably secured by a spring-loaded detent 320. When the detent 320 is released, the handle 24 may be disengaged from the handle section 22 to be utilized as an air pump handle, as will be explained. The position of the handle, when detached, is shown in dotted lines in FIG. 8.

The fluid or water supply conduits 28 extend from the reservoir 30 to the mist nozzles across valve 40. The air pump 350 is a manual air pump having a tubular cylinder 352 within the chamber 30. The air pump contains a piston 355 which is connected to the grip 24 which serves as a pump handle by means of actuator rod 360. The rod or shaft 360 attached to the piston provides for manual reciprocation of the piston 355. The air pump operates in a manner similar to that utilized in hand-held yard sprayers. A similar pump system is also described in U.S. Pat. No. 5,620,140 which description is incorporated by reference.

In use, the reservoir may be suitably filled with a fluid at plug 44. The plug is replaced when the reservoir is filled. The user may then disengage the grip 24 by depressing the detent 320. The grip may then be used to reciprocate or stroke the piston to pressurize the contents of the reservoir.

From the foregoing, it may be seen that the present invention provides a unique, portable and highly versatile device. The device may be used as a simple umbrella or parasol to provide shade and protection to the user. In hot conditions, the device may provide the added feature of providing a misting cooling spray which is directed downwardly onto and the area around the user. The device is light weight, portable and may be easily carried by the user and collapsed to a compact unit for storage when not in use.

The device requires no external power or electrical connections. The configuration of the grip and the material and size and shape of the canopy can be selected in accordance with the preference of the user. For example, the grip can be provided in various decorative shapes and the material of the canopy can be decorator-style fabrics. The device creates a fine mist around the user to provide cooling but not disperse sufficient moisture to wet the user.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A portable personal environmental protection and cooling device comprising:

(a) a canopy having a periphery;

(b) a tubular handle section defining a fluid reservoir and a chamber separated by a wall having a first valve, said chamber containing a gas containing cartridge having a rupturable seal;

(c) at least one spray nozzle secured adjacent the periphery of the canopy to direct a cooling mist downwardly;

(d) a flexible conduit connecting said reservoir and said nozzle;

(e) a second control valve disposed in said conduit;

(f) a projection on said wall aligned with said rupturable seal; and (g) a lower grip handle section moveable relative to said tubular handle section having a surface engageable with said cartridge to displace said cartridge to move the cartridge seal into engagement with said projection to puncture said seal to release gas across said first valve into said fluid reservoir.

2. The device of claim 1 wherein said canopy is collapsible between an open use position and a folded, non-use storage position.

* * * * *